United States Patent [19]

Cuschera

[11] Patent Number: 4,597,112

[45] Date of Patent: Jul. 1, 1986

[54] SPRING SEALED DRAIN FITTING

[76] Inventor: Casper Cuschera, 1047-77th Ave., Oakland, Calif. 94621

[21] Appl. No.: 731,943

[22] Filed: May 8, 1985

[51] Int. Cl.[4] ..... A47K 1/14

[52] U.S. Cl. ..... 4/287; 4/295

[58] Field of Search ..... 4/287, 286, 288, 295; 251/74, 75

[56] References Cited

U.S. PATENT DOCUMENTS

| | | | |
|---|---|---|---|
| 3,220,695 | 11/1965 | Downey et al. | 251/74 |
| 3,468,512 | 9/1969 | Politz | 4/295 |
| 3,605,132 | 9/1971 | Lineback | 137/542 |
| 4,006,498 | 2/1977 | Cuschera | 4/191 |
| 4,007,500 | 2/1977 | Thompson | 4/295 |
| 4,100,629 | 7/1978 | Jones et al. | 4/295 |
| 4,144,599 | 3/1979 | Cuschera | 4/287 |
| 4,276,662 | 7/1981 | Young | 4/287 |
| 4,359,788 | 11/1982 | Liou | 4/287 |
| 4,369,531 | 1/1983 | Swanson | 4/286 |
| 4,447,918 | 5/1984 | Cuschera | 4/286 |

*Primary Examiner*—Stephen Marcus
*Assistant Examiner*—Leo J. Peters
*Attorney, Agent, or Firm*—Harris Zimmermann; Howard Cohen

[57] ABSTRACT

A drain fitting for bathtubs, sinks or the like has an annular body and a closure member which may be seated against the inlet end of a drain passage through the body. A stem extends from the closure member through a guide element within the drain passage and a spring acts between the stem and guide element to apply sealing pressure to the seated closure member. The closure member may be manually pulled outwardly from the body against the force of the spring and turned angularly to latch the member at an open position when fluid is to be drained. The positive sealing force generated by the spring minimizes or avoids leakage under conditions where the forces of gravity and pressure from overlying liquid may be inadequate for the purpose.

6 Claims, 7 Drawing Figures

SPRING SEALED DRAIN FITTING

TECHNICAL FIELD

This invention relates to valve constructions and more particularly to fittings for selectively opening and closing drain openings in bathtubs, wash basins, sinks and the like.

BACKGROUND OF THE INVENTION

Fittings for controlling flow through drain openings typically have a closure member which seats against the inlet end of the opening either directly or through an annular resilient sealing element. The closure member is coupled to other components through mechanism for shifting the closure member outward from the drain opening when fluid is to be drained through the fitting.

Such mechanism in a number of prior drain fittings of this kind includes a spring or an elastomeric sleeve which acts to urge the closure member away from the closed or seated position. Such fittings are closed by manually forcing the closure member to the seated position against the force of the spring. Detents or other latching means then engage to resist the spring force so that the closure member may remain at the seated position. Prior mechanisms of this kind resist movement of the closure member away from the seated position but do not apply any significant positive sealing pressure to the closure member when it is at that position.

Prior drain fittings of this type rely on a combination of gravity and the pressure of overlying liquid to apply sealing force to the closure member. These forces are not always as effective for the purpose as would be desirable. Drain fitting components are usually not particularly massive and thus the gravitationally generated force is limited. Fluid pressure is dependent on the height of the liquid above the drain closure and there is frequently only a minimal volume of such liquid present, particularly during initial filling of a bathtub, wash basin, kitchen sink or the like and occasionally at other times as well. Turbulence and the motions of persons using the installation can also cause some slight unseating of the closure member. Insufficient sealing force also detracts from the effectiveness of elastomeric seals where these are present in drain fittings.

Consequently, some leakage of liquid through drain fittings has been a common occurrence. While this is usually tolerable and generally accepted, it would be preferable to avoid or minimize such leakage for a number of reasons. Replenishing the liquid in a bathtub or sink during use can be a significant inconvenience. Efforts are being made in many regions to conserve limited water supplies and leakage of the above discussed kind is counterproductive to such programs. Additives such as soap, detergents or medications, for example, are often present in sinks or bathtubs and leaking drain fittings cause a wastage of such materials.

The present invention is directed to overcoming one or more of the problems discussed above.

SUMMARY OF THE INVENTION

In one aspect of the present invention, a drain fitting has an annular body adapted to be fitted into a drain opening and which defines a drain passage, a flow transmissive spider member attached to the body and extending across the drain passage, and a closure member movable towards the spider member and away from the spider member between the closed positon at which flow is blocked from the drain passage and an open position at which flow may enter the passage. The drain fitting further includes spring means for resiliently urging the closure member towards the closed position and latching means for selectively holding the closure member at the open position in opposition to the force of the spring means.

In another more specific aspect of the invention, a fitting for a drain opening includes an annular body proportioned for disposition in the drain opening and forming a drain passage with an inlet end and an outlet end. A closure member proportioned for seating at the inlet end of the drain passage includes means for enabling grasping of the closure member to pull the closure member away from the drain passage. A spider member extends across the drain passage in spaced relationship from the inlet end and a guide element secured to the spider member has a guide passage that is coaxial with the drain passage, the guide element also having a surface facing the closure member and a longitudinal slot extending from the surface towards the spider member. A stem extends from the closure member through the guide passage and has an end portion which extends away from the side of the spider member that is opposite from the closure member. A helical compression spring disposed on the end portion of the stem acts against a radially extending element on the stem which is positioned to maintain the spring in a state of partial compression when the closure member is seated at the inlet end of the drain passage. A latching element extends radially from the stem in position to extend into the longitudinal slot of the guide element when the closure member is seated at the inlet of the drain passage and to abut the surface of the guide element when the closure member is pulled away from the inlet and turned angularly.

The invention very effectively inhibits leakage by maintaining a sizable degree of sealing force on the seated drain closure under conditions where gravity and fluid pressure may be inadequate for the purpose.

DETAILED DESCRIPTION OF THE PREFERRED EMBODIMENT

Figure 1:
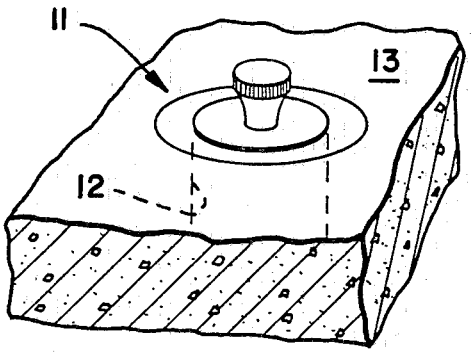
FIG. 1 is a perspective view of a drain fitting in accordance with one embodiment of the invention as it appears when installed in a drain opening.

Referring initially to FIG. 1 of the drawings, the drain fitting 11 of this embodiment is adapted for installation in the drain opening 12 in the floor 13 of a bathtub, kitchen sink, wash basin or other receptacle for temporarily holding a volume of water or other liquid.

Figure 2:
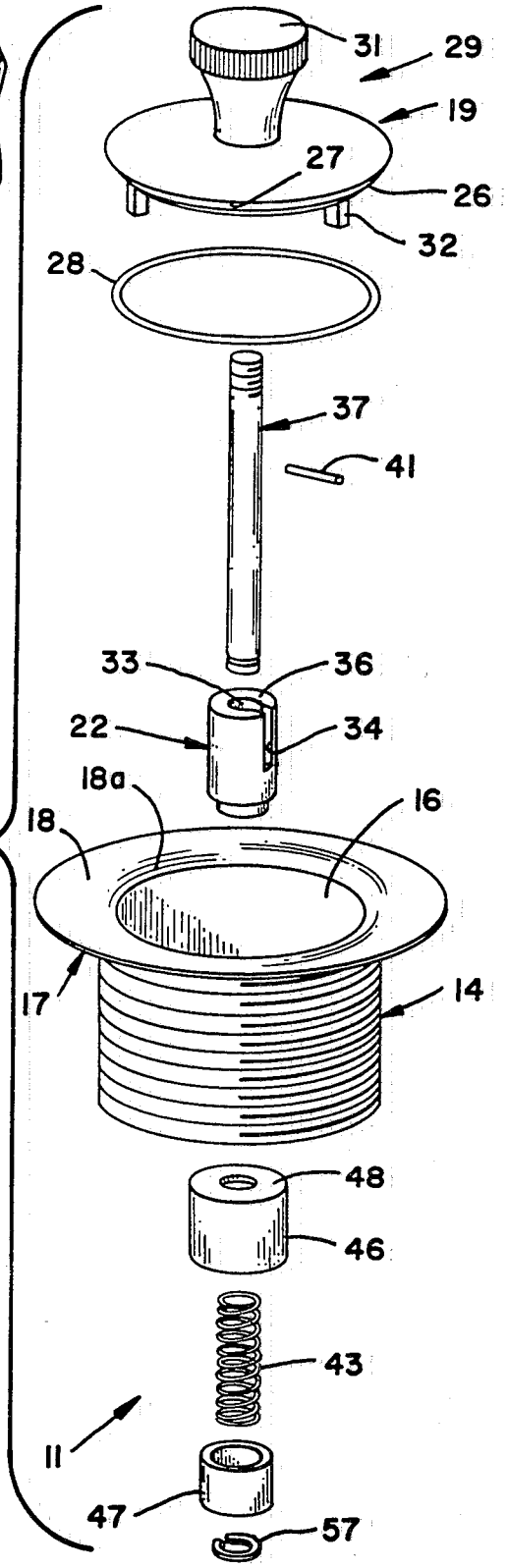
FIG. 2 is an exploded view of the drain fitting of FIG. 1 showing internal components.
Figure 3:
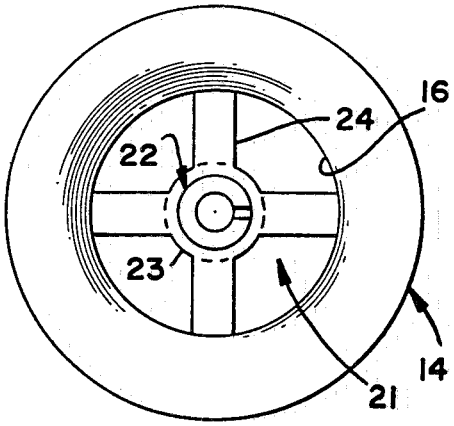
FIG. 3 is a top view of the drain fitting of FIGS. 1 and 2 with the closure member removed.

Referring to FIG. 2, fitting 11 has an annular body 14 which is externally threaded to facilitate installation and which forms the drain passage 16. Body 14 is provided with a flange 17 at the upper or inlet end of the drain passage 16, the upper inner surface 18 of the flange being slanted towards the drain passage to define an annular seat 18*a* for a cover or closure member 19. Referring now to FIG. 3, a flow transmissive spider member 21 extends across the lower or outlet end of drain passage 16 to support a guide element 22 at the axis of the drain passage. Spider member 21 has a center ring portion 23 to which the lower end of the guide element 22 is secured and four equi-angularly spaced radially directed arms 24 which connect to body 14 although other configurations may also be employed.

Referring again to FIG. 2, closure member 19 is circular and has an annular side surface 26 which is slanted similarly to the surface 18*a* of body 14 in order to be seatable against that surface to close drain passage 16. In this example, the closure member 19 has a groove 27 in side surface 26 for receiving an elastomeric o-ring sealing element 28. Other known forms of elastomeric sealing element may also be used or such a sealing element may not be necessary in some cases such as where the closure member 19 is itself formed of somehat resilient material instead of metal.

The upper surface of closure member 19 is provided with means 29 for enabling grasping and turning of the member, such means being a knob 31 in this particular embodiment. Three tangs 32, angularly spaced apart by 120°, extend a short distance downward from the underside of closure member 19 to prevent large objects from entering the drain passage 16 when the closure member is in the elevated or open position and to strengthen the mechanism against lateral forces which may be exerted on knob 31 when the closure member is seated on surface 18*a*.

Guide element 22 is a cylinder defining a guide passage 33 which is coaxial with the larger drain passage 16. A longitudinal slot 34 in the sidewall of the guide element 22 extends downward from the end surface 36 of the guide element that faces closure ember 19.

Figure 4:
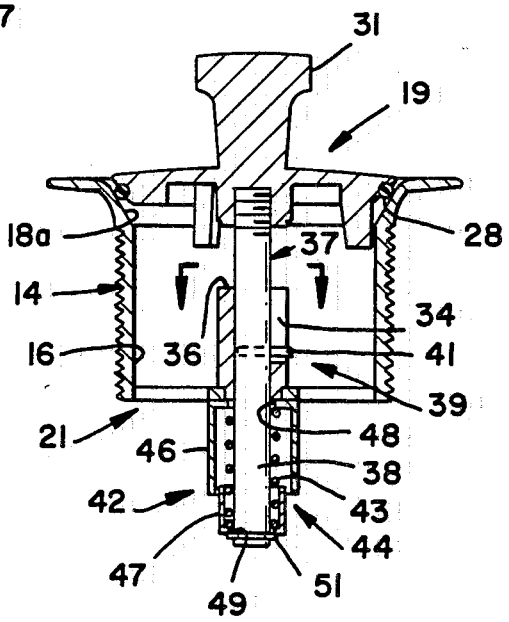
FIG. 4 is an axial section view of the drain fitting of the preceding figures shown in the closed position.
Figure 5:
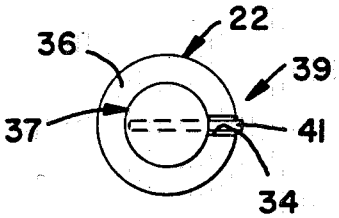
FIG. 5 is a partial cross section taken along line V—V of FIG. 4.

Referring to FIG. 4, a rod shaped stem 37 extends down from the center of closure member 19 through guide passage 33 and has an end portion 38 that extends a distance below spider member 21. latching means 39 for selectively holding closure member 19 in the open position includes, in this embodiment, a pin 41 that extends radially from stem 37. As depicted in FIGS. 4 and 5, pin 41 is positioned on stem 37 to be received in slot 34 of the guide element 22 when closure member 19 is seated against surface 18*a* of body 14 and to abut end surface 36 of the guide element when the closure member is pulled away to the open position and turned angularly as depicted in FIGS. 6 and 7.

To realize the objective of avoiding leakage, drain fitting 11 further includes means 42 for resiliently urging closure member 19 towards the closed or seated position of the member. With reference again to FIG. 4, such means 42 in this embodiment has a helical compression spring 43 disposed coaxially on the lower end portion 38 of stem 37 which urges the end portion of the stem downwardly. Spring 43 is preferably substantially enclosed by an axially contractable spring housing 44 to keep small objects which may be carried into the drain passage 16 from lodging in the spring and possibly interfering with contraction and extension of the spring.

Spring housing 44 in this embodiment is formed by telescoping upper and lower cylinders 46 and 47 respectively which are disposed in coaxial relationship with spring 43 below spider member 21. An inwardly extending lip 48 at the upper end of cylinder 46 is held against the underside of the spider member 21 by pressure from the upper end of spring 43. Lower cylinder 47, which is of smaller diameter than the upper cylinder, is proportioned to extend a small distance into the upper cylinder when closure member 19 is at the closed or seated position. The lower end of spring 43 bears against an inwardly extending lip 49 at the base of lower cylinder 47 and the lip bears against a snap ring 51 or other radially extending element engaged on the end of stem 37. The outer diameter of lower cylinder 47 is slightly less than the inner diameter of upper cylinder 46 and lips 48 and 49 fit loosely on stem 37 so that water cannot become entrapped within the housing 42 and prevent lifting of closure member 19.

Figure 6:
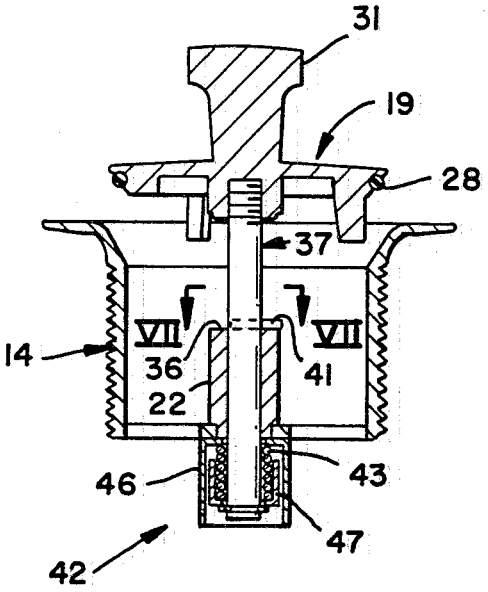
FIG. 6 is an axial section view of the drain fitting of the preceding figures shown in the open position.
Figure 7:
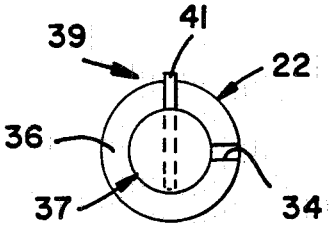
FIG. 7 is a partial cross section taken along line VII—VII of FIG. 6.

In operation, drain fitting 11 may be opened by grasping knob 31 and pulling closure member 19 upward to the position depicted in FIGS. 6 and 7. The fitting 11 may then be latched in the open position by turning the closure member to cause pin 41 to overlie the upper end surface 36 of guide element 22 and thereby resist the force of spring 43. Reverse turning of the closure member 19 brings pin 41 over slot 34. Spring 43 then extends drawing the closure member 19 downward to the closed position depicted in FIGS. 4 and 5 with a snap action.

Spring 43 is proportioned to remain in a state of partial compression when the closure member 19 is at the closed position. Consequently, the spring 43 continues to exert a downward force on closure member 19 at that time to assure tight sealing, to resist displacement of the closure member and to compress out possible worn areas or other irregularities in the sealing element 28.

While the invention has been described with reference to a particular preferred embodiment, numerous structural variations are possible and it is not intended to limit the invention except as defined in the following claims.

I claim:

1. In a drain fitting having an annular body adapted to be fitted into a drain opening and which defines a drain flow passage therethrough, a flow transmissive spider member attached to said body and extending across said drain flow passage, a closure member movable towards said spider and away therefrom between a closed position at which flow is blocked from said drain passage and an open position at which flow may enter said drain passage, the improvement comprising:

spring means for resiliently urging said closure member towards said closed position thereof, latching means for selectively holding said closure member at said open position thereof in opposition to the force of said spring means, guide means secured to said spider member and having a guide passage which is coaxial with said drain passage, a stem extending from said closure member through said guide passage and having an end closure member, wherein said spring means includes a helical compression spring disposd coaxially on said end portion of said stem and being positioned to urge said end portion of said stem outwardly from said opposite side of said spider member, said spring means being proportioned to remain in a state of partial compression when said closure member is at said closed position thereof.

2. The apparatus of claim 1 further including an axially contractable cylindrical spring housing positioned to at least substantially enclose said spring.

3. The apparatus of claim 2 wherein said spring housing includes a first sleeve fixed to said spider member and a second coaxial sleeve of smaller diameter which is movable with said stem and positioned to telescope into said first sleeve as said closure member is moved from said closed position to said open position.

4. The apparatus of claim 1 wherein said guide member has an end surface facing said closure member and a longitudinal slot in the wall of said guide member, said slot extending from said end surface towards said spider member, and wherein said latching means includes a latch member extending radially from said stem, said latch member being positioned to extend into said slot when said closure member is at said closed position thereof and to abut said end surface of said guide member when said closure member is moved to said open position and turned angularly relative to said guide member.

5. In a drain fitting having an annular body adapted to be fitted into a drain opening and which defines a drain flow passage therethrough, a flow transmissive spider member attached to said body and extending across said drain flow passage, a closure member movable towards said spider and away therefrom between a closed position at which flow is blocked from said drain passage and an open position at which flow may enter said drain passage, the improvement comprising:

spring means for resiliently urging said closure member towards said closed position thereof, latching means for selectively holding said closure member at said open position thereof in opposition to the force of said spring means, said closure member including means for enabling grasping of said closure member to pull said closure member from said closed position to said open position against the force of said spring means and to enable turning of said closure member to engage said latching means.

6. A fitting for a drain opening comprising:

an annular body proportioned for disposition in said drain opening and forming a drain passage with an inlet end and an outlet end, a circular closure member proportioned for seating at said inlet end of said drain passage to stop flow therethrough and including means for enabling grasping of the closure member to pull said closure member away from said drain passage, a spider member extending across said drain passage in spaced apart relationship from said inlet end thereof, a guide element secured to said spider member and having a guide passage which is coaxial with said drain passage, said guide element having a surface facing said closure member and having a longitudinal slot extending from said surface towards said spider member, a stem extending from said closure member through said guide passage and having an end portion which extends away from said spider member at the opposite side thereof from said closure member, a helical compression spring disposed on said end portion of said stem in coaxial relationship therewith, a radially extending element on said stem against which said spring acts and which is positioned on said stem to maintain said spring in a state of partial compression when said closure member is seated at said inlet end of said drain passage, and a latching element extending radially from said stem in position to extend into said longitudinal slot of said guide element when said closure member is seated at said inlet end of said drain passage and to abut said surface of said guide element when said closure member is pulled away from said inlet end of said drain passage and turned angularly.

* * * * *